US012448966B2

(12) United States Patent
Robinson et al.

(10) Patent No.: US 12,448,966 B2
(45) Date of Patent: Oct. 21, 2025

(54) END PLATES AND INNER PLATE BUSHINGS FOR PUMPS

(71) Applicant: T & E Pumps Ltd., Consort (CA)

(72) Inventors: Rachel Robinson, Consort (CA); Brad Kelts, Consort (CA); Rory Berg, Consort (CA)

(73) Assignee: T & E Pumps Ltd., Consort (CA)

( * ) Notice: Subject to any disclaimer, the term of this patent is extended or adjusted under 35 U.S.C. 154(b) by 0 days.

(21) Appl. No.: 18/394,018

(22) Filed: Dec. 22, 2023

(65) Prior Publication Data

US 2024/0125358 A1 Apr. 18, 2024

Related U.S. Application Data

(62) Division of application No. 17/301,093, filed on Mar. 24, 2021, now abandoned.

(60) Provisional application No. 63/018,858, filed on May 1, 2020.

(51) Int. Cl.
*F04C 15/00* (2006.01)

(52) U.S. Cl.
CPC ..... *F04C 15/00* (2013.01); *F04C 2230/21* (2013.01); *F04C 2240/30* (2013.01); *F04C 2240/56* (2013.01)

(58) Field of Classification Search
CPC .. F04C 2230/21; F04C 2240/30; F04C 29/00; F04C 2/08; F04C 2230/10; F04C 2240/56
See application file for complete search history.

(56) References Cited

U.S. PATENT DOCUMENTS

| | | | | |
|---|---|---|---|---|
| 4,408,968 | A * | 10/1983 | Inagaki | F04C 18/3441 418/255 |
| 9,927,032 | B2 | 3/2018 | Grover | |
| 2012/0204818 | A1* | 8/2012 | Welte | F04D 15/0038 123/41.08 |
| 2014/0348686 | A1* | 11/2014 | Paval | F04C 2/16 418/201.1 |
| 2017/0204854 | A1* | 7/2017 | Afshari | F04C 15/0096 |
| 2018/0094737 | A1 | 4/2018 | Clement et al. | |

OTHER PUBLICATIONS

Lakeside Supply Company, "Pipe Fittings", Dec. 14, 2015, URL: <https://web.archive.Org/web/20151224022254/https://www.lakesidesupply.com/lakesidesupply/catalog/pdfs/anvil.pdf>, pp. 1-28 (Year: 2015).

Kashyap, "What is a Pipe Tee and How to Select Pipe Tee", Mar. 12, 2022, URL: <https://www.linkedin.com/pulse/what-pipe-tee-how-select-pawan-kashyap?trk=articles_directory>, pp. 1-6 (Year: 2022).

* cited by examiner

*Primary Examiner* — Bryan M Lettman
(74) *Attorney, Agent, or Firm* — CPST Intellectual Property Inc.; Brett J. Slaney

(57) ABSTRACT

A cast for producing end plates for a pump assembly, the cast comprising a base portion and a pair of projections, the pair of projections providing material to machine bearing assembly housings for accommodating drive and idler shafts in the pump assembly. Also provided is an inner plate bushing for an end plate in a pump assembly, the inner plate bushing comprising a collar extending from a flange, the collar to be inserted into a mounting recess in the end plate with the flange seating flush with a surface of the end plate, the surface area of an end of the collar being larger than an inner surface of the flange.

18 Claims, 8 Drawing Sheets

END PLATES AND INNER PLATE BUSHINGS FOR PUMPS

CROSS-REFERENCE TO RELATED APPLICATION(S)

This application is a Division of U.S. patent application Ser. No. 17/301,093 filed Mar. 24, 2021, which claims priority to U.S. Provisional Patent Application No. 63,018,858 filed on May 1, 2020, the contents of which are incorporated herein by reference.

TECHNICAL FIELD

The following relates to end plates and inner plate bushings for pumps.

BACKGROUND

Fluid pumps are known for use in pumping liquids and fluids, such as oils and distillates produced from oil wells. The oils and distillates can also contain contaminant materials, such as sand, grit and the like. The pumping of such fluids results in the gritty materials that are found in the fluid to come into contact with the pump internal elements such as the pump bearings and the seals, which is disadvantageous as the pump elements exposed routinely to entrained gritty materials have a tendency to wear prematurely and fail after a short period of use.

Accordingly, there is a need to increase the serviceability of pumps and to increase the operating life of pumps involving pumping fluids containing grit contaminants. More particularly, there is a need for the mechanical components that are used to couple the pump to a motor to limit the contaminants entering into the internal pump components (e.g., from outside the pump housing). Additionally, there is a need for the coupling components to limit the contaminants entering into the motor housing. Therefore, it is an object of the following to obviate or mitigate at least some of the above presented disadvantages.

SUMMARY

In one aspect, there is provided a cast for producing end plates for a pump assembly, the cast comprising a base portion and a pair of projections, the pair of projections providing material to machine bearing assembly housings for accommodating drive and idler shafts in the pump assembly.

In another aspect, there is provided a method for producing an end plate for a pump housing, comprising: pouring a material into a mold, the mold defining a base portion and a pair of projections; forming a cast from the mold; and machining the base portion and projections to create fastener mounts and to accommodate drive and idler shafts in the pump assembly.

In yet another aspect, there is provided an inner plate bushing for an end plate in a pump assembly, the inner plate bushing comprising a collar extending from a flange, the collar to be inserted into a mounting recess in the end plate with the flange seating flush with a surface of the end plate, the surface area of an end of the collar being larger than an inner surface of the flange.

BRIEF DESCRIPTION OF THE DRAWINGS

Embodiments will now be described with reference to the appended drawings wherein.

DETAILED DESCRIPTION

There are generally provided end plates for a pump assembly that are formed from a cast and are preferably formed from cast iron to reduce cost and the number of parts when compared to traditional steel end plates. There is also provided an enhanced inner plate bushing that is formed having a larger diameter and a greater thickness. The inner plate bushing, enhanced in this way, facilitates assembly of the pump assembly, particularly assembly of the end plates with the pump housing. The enhanced inner plate bushings also provide longer wear life due to the increased thickness and have a greater impact on the sealing system by providing increased coverage and more stability when compared to prior bushings, grit collars and the like.

Figure 1:
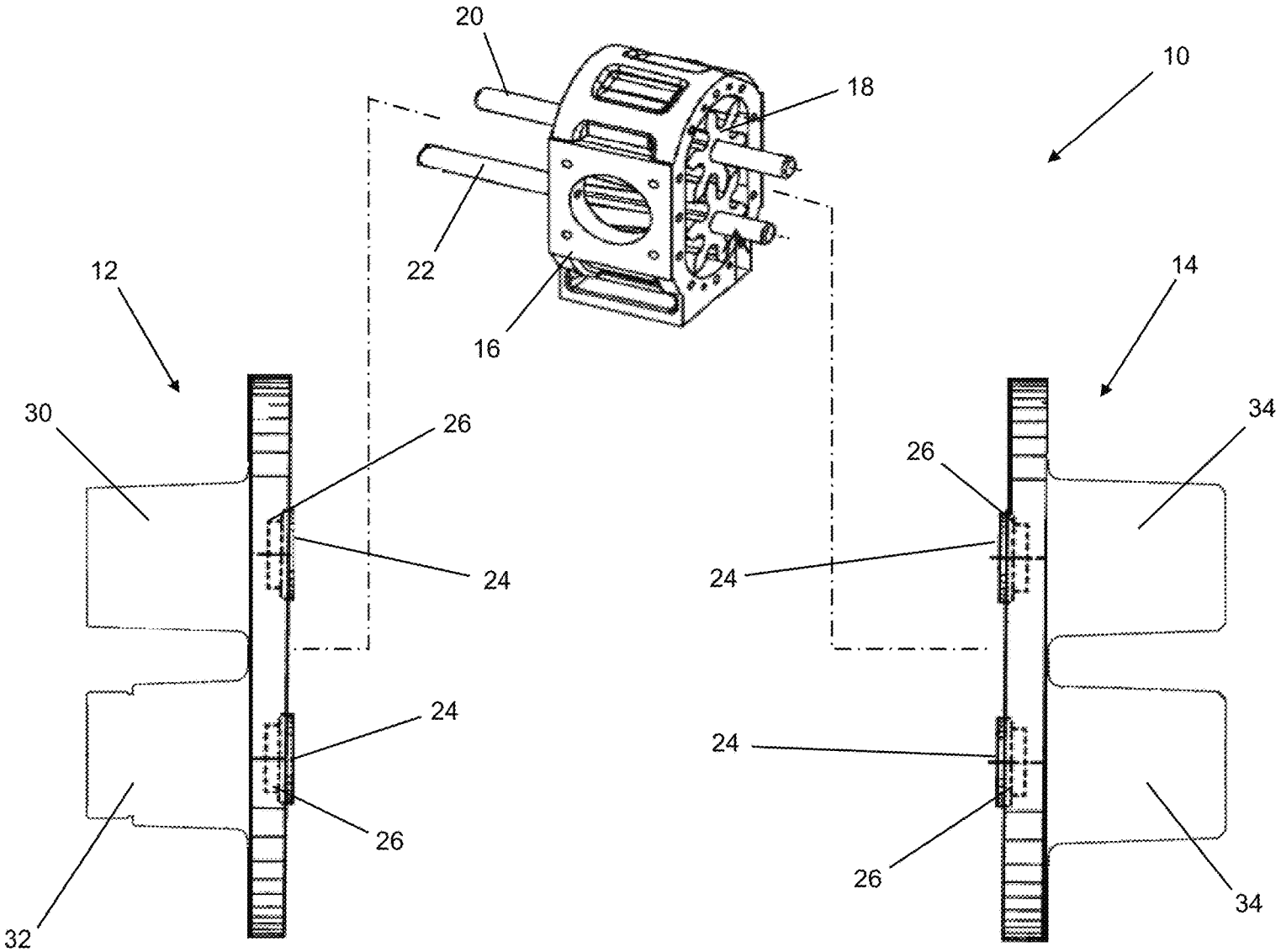
FIG. 1 is an exploded side view of a pair of cast end plates with enhanced inner plate bushings and shafts that extend through the end plates.

Turning now to the figures, FIG. 1 illustrates certain components of a pump assembly 10, with several components omitted for ease of illustration. FIG. 1 illustrates a front end plate 12, a rear end plate 14, and a pump housing 16. The front and rear end plates 12, 14 are formed by casting a suitable material, preferably cast iron to reduce cost and reduce the number of components in the assembly 10 as discussed in greater detail below. The pump housing 16 in this example contains a pair of helical gears 18, a drive shaft 20 to rotatably support one of the gears 18, and an idler shaft 22 to rotatably support the other of the gears 18. The end plates 12, 14 are used to align the internal components, receive the shafts 20, 22 and otherwise seal the pump cavity in the housing 16 as is known in the art. In this way, the gears 18 can be operated to pump fluid by capturing the fluid between the teeth of the gears to cause the fluid to be pumped through the cavity of the pump. Not shown in FIG.

1, the end plates 12, 14 would sealingly engage the pump housing 16 on opposite sides, e.g., via wear plates interposed between the endplates 12, 14 and the pump housing 16. On the interior side of each of the end plates 12, 14 is a pair of mounting recesses 26 surrounding shaft passages and sized and contoured to permit enhanced inner plate bushings 24 to be seated therein. In the configuration shown in FIG. 1, the same inner plate bushing 24 can be used at each inner plate mounting recess 26 thus minimizing the number of dissimilar parts and to facilitate the production of replacement parts for such bushings 24.

Figure 2:
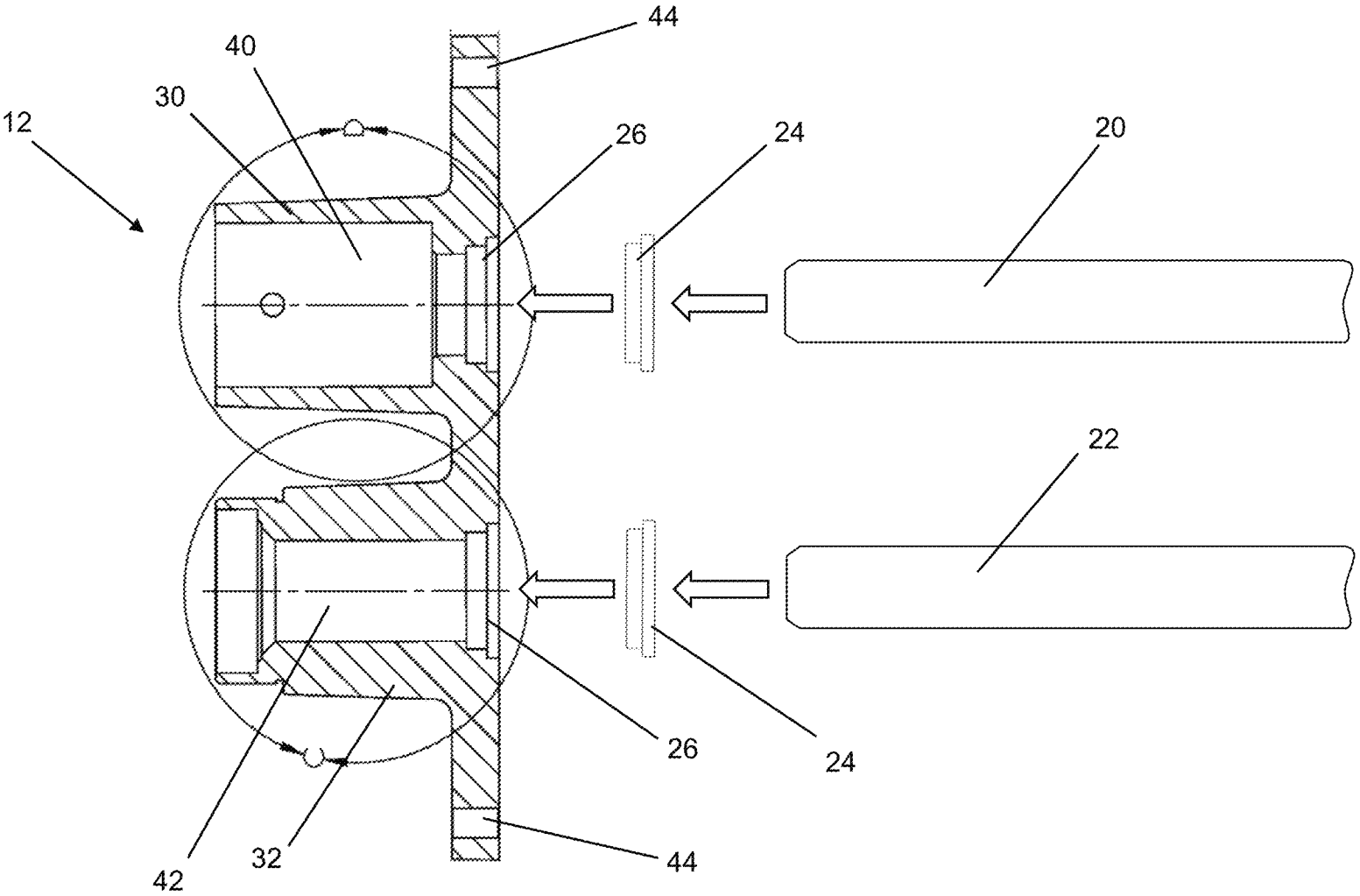
FIG. 2 is an exploded side view with a cross-section of an end plate showing enhanced inner plate bushings.

The front end plate 12 includes a drive (input) bearing assembly housing 30 aligned with the drive shaft 20 and an idler bearing assembly housing 32 aligned with the drive shaft 20. The rear end plate includes a pair of end cap bearing assembly housings 34 aligned with the respective shafts 20, 22. The housings 30, 32, 34 contain bearings or bushings and/or seals for supporting and enabling rotation of the shafts 12, 14. Access to such bearings or bushings and/or seals can be made on the front end plate 12 through removable end caps or removable packing nut holders (not shown) or by removing the end plate 12, 14. The bushings, bearings or seals can be changed by tapping the bushing and inserting a plug and using a tool to push the components from the endplate 12, 14 after removing the end plate 12, 14 from the pump housing 16. FIG. 2 provides an exploded view with a cross-section of the front end plate 12 and illustrates the assembly of the shafts 12, 14 by insertion through the inner plate bushings 24 and the passages in the mounting recesses 26. As can also be seen in FIG. 2, the drive bearing assembly housing 30 includes a cavity 40 to contain the bearings or bushings and seals, and to enable the drive shaft 20 (i.e., the input) to pass therethrough. The idler bearing assembly housing 32 also includes a cavity 42 that is shaped to enable an end of the idler shaft 20 to be inserted thereinto and contains clearance for seals and/or bearings. The mounting recesses 26 are profiled to allow the inner plate bushings 24 to be seated and provide a substantially flush surface relative to the inner surface of the front end plate 12. Also shown in FIG. 2 are fastener mounts 44 (e.g., holes or passages) that are provided to enable the end plate 12 to be fastened to the pump housing 16, e.g., using a series of bolts through such holes or passages. It can be appreciated that the inner plate bushings 24 are similarly seated in the mounting recesses 26 of the rear end plate 14.

Figure 3:
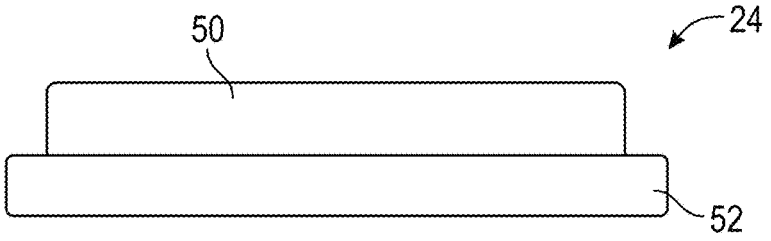
FIG. 3 is an elevation view of an enhanced inner plate bushing.
Figure 4:
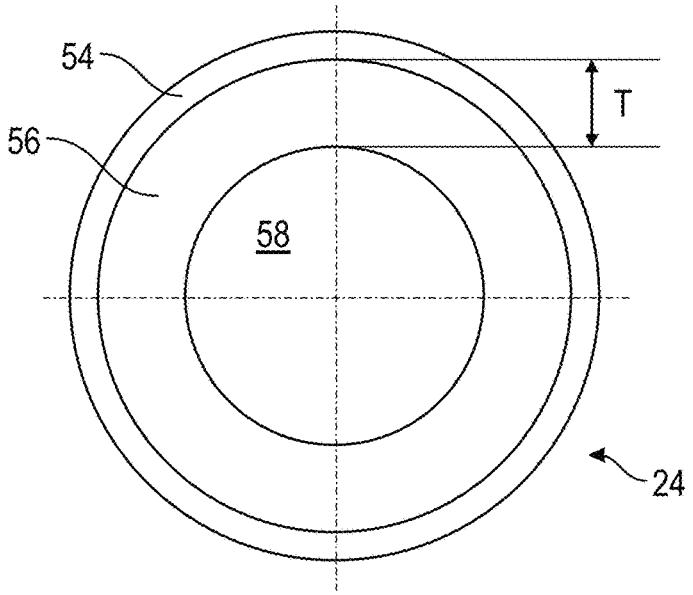
FIG. 4 is a bottom view of the enhanced inner plate bushing of FIG. 3.
Figure 5:
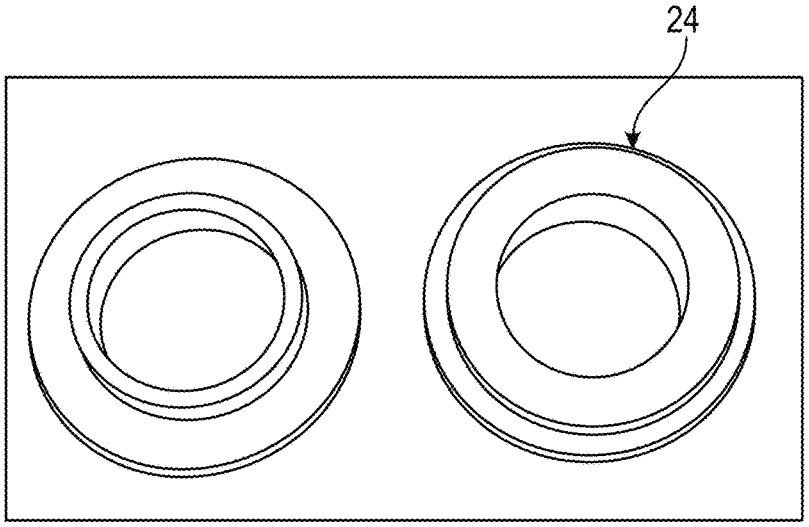
FIG. 5 is a side-by-side comparison view of a prior art inner plate bushing and an enhanced inner plate bushing.

Further detail concerning the enhanced inner plate bushing 24 is shown in FIGS. 3-5. The inner plate bushing 24 includes a collar 50 extending from a flange 52. As seen in FIG. 4, the inner plate bushing 24 is enhanced by increasing the thickness of the collar 50 when compared to prior bushings used for similar purposes (as seen by comparison in FIG. 5). The increased thickness of the collar 50 provides a relatively larger thrust surface 56 for the collar 50 when compared to the thrust surface 54 for the flange 52. While exact dimensions may vary, it is observed that the thickness of the collar 50 relative to the width of the flange 52 results in the surface 56 having a larger surface area than the surface area of surface 54, which is the opposite of prior bushings as seen in FIG. 5. The inner plate bushings 24 are preferably machined from a metal such as bronze.

The increased thickness not only contributes to a longer life for the inner plate bushing 24, it also creates a larger opening in the mounting recess 26, which creates more space to access and service the bearings or bushings and seals within the bearing assembly housings 30, 32, 34. The larger service opening balances the competing objectives of the convenience of the casting process (creating a unitary end plate 12, 14 with housings 30, 32, 34) and serviceability of the parts contained therein.

The surfaces 54, 56 surround a central passage 58 through which a shaft 12, 14 is received. The enhanced inner plate bushing 24 facilitates assembly of the pump assembly 10, particularly assembly of the end plates 12, 14 with the pump housing 16. As noted above, the increased thickness of the collar 50 allows for the central passage 58 to be sized to permit the shafts 12, 14 to be inserted therethrough while allowing for a larger bore in the mounting recess 26 behind the surface 56 of the collar 50 to permit access to the housings 30, 32, 34 from the inner side of the end plate 12, 14. The enhanced inner plate bushings 24 also provide longer wear life due to the increased thickness of the collar 50 and have a greater impact on the sealing system by providing increased coverage and more stability when compared to prior bushings, grit collars and the like. The greater wear life can mean increased time between servicing. The increased coverage can provide a better seal to inhibit grit and other contaminates from entering one of the bearing assemblies 30, 32, 34. While not being limited thereto, example dimensions can include an overall width for the bushing 24 having a diameter of approximately 2 inches, with a central passage of diameter of approximately 1.13 inches, the depth of the flange 52 of about 0.14 inches, the depth of the collar of about 0.2 inches, and the width (i.e. thickness) of the collar 50 of about 0.3 inches (e.g., 0.305 inches)—identified as "T" in FIG. 4. It can be appreciated that dimension T in FIG. 4 compares to the prior thickness of the bushing (shown to the left in FIG. 5) of approximately 0.120 inches.

Figure 6:
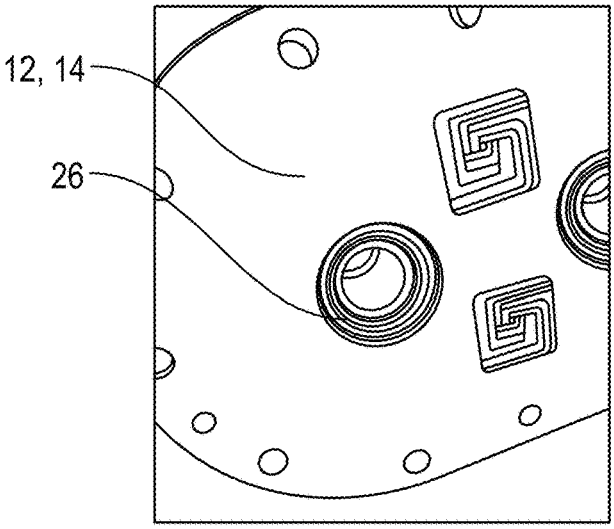
FIG. 6 is a perspective view of an end plate.
Figure 7:
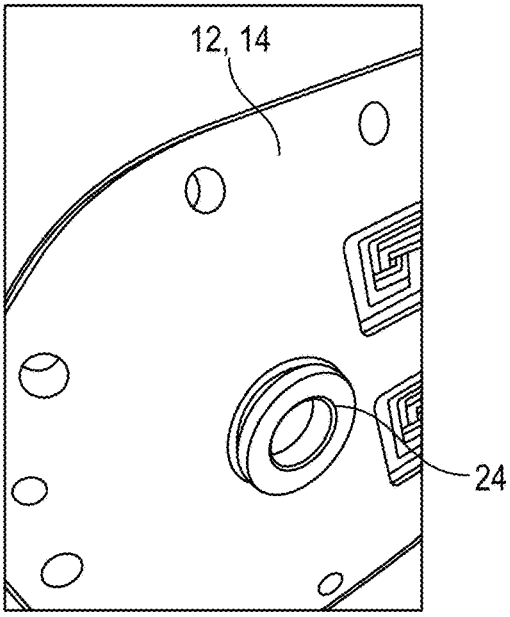
FIG. 7 is a perspective view of an end plate with an enhanced inner plate bushing being inserted.
Figure 8:
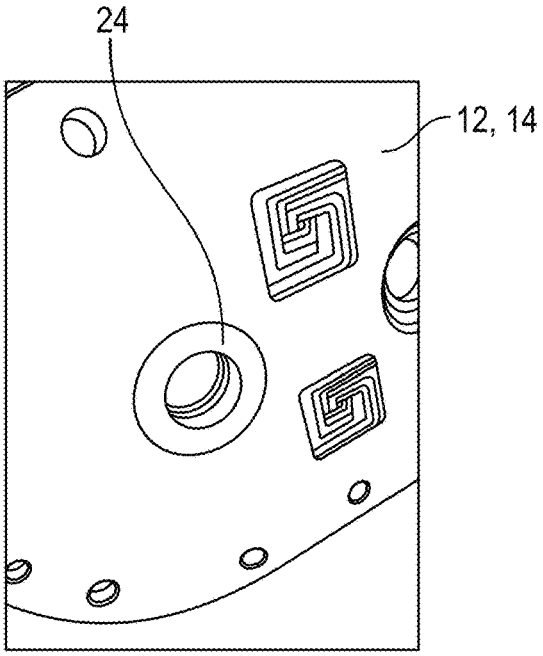
FIG. 8 is a perspective view of an end plate with an enhanced inner plate bushing when inserted.

The inner surface of an end plate 12, 14 is shown in FIGS. 6-8, with FIG. 6 showing a mounting recess 26, with FIG. 7 illustrating the seating of an enhanced inner plate bushing 24, and with FIG. 8 showing the bushing 24 in a fully seated position in the mounting recess 26.

Figure 9:
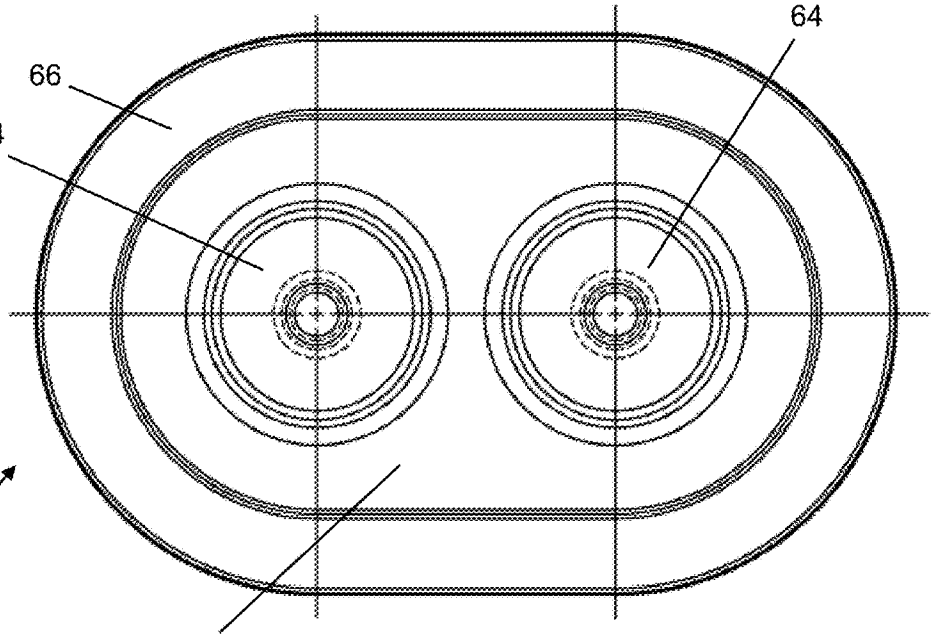
FIG. 9 is a perspective view of a cast for an end plate.
Figure 10:
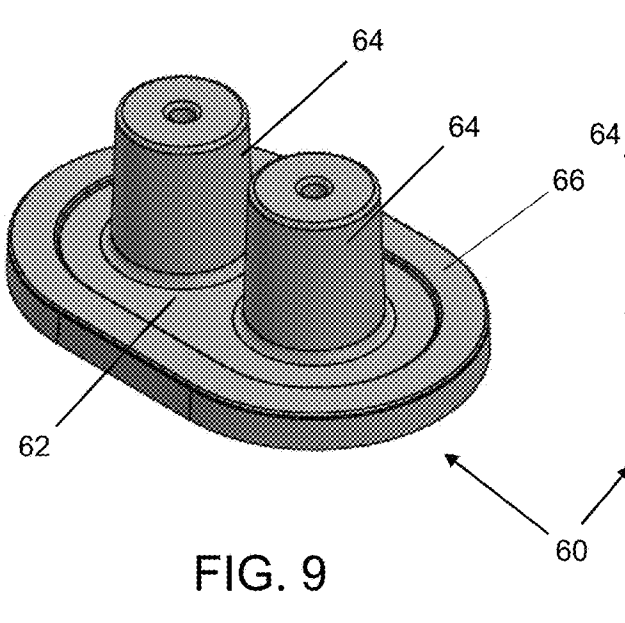
FIG. 10 is a plan view of the cast of FIG. 9.
Figure 11:
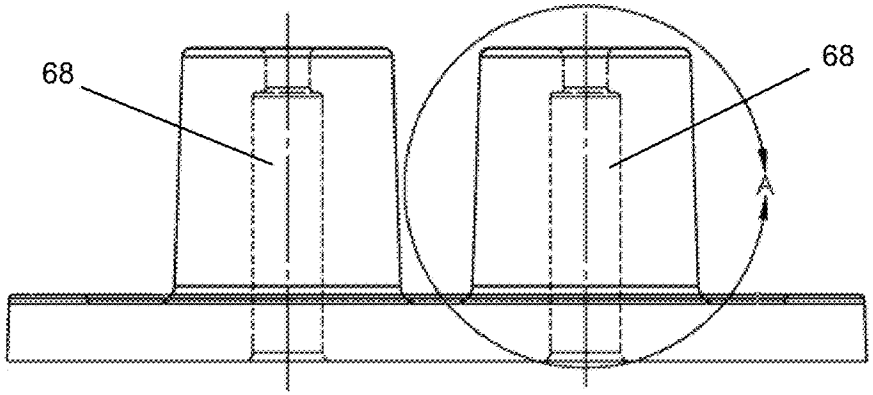
FIG. 11 is a side view of the cast of FIG. 10.
Figure 12:
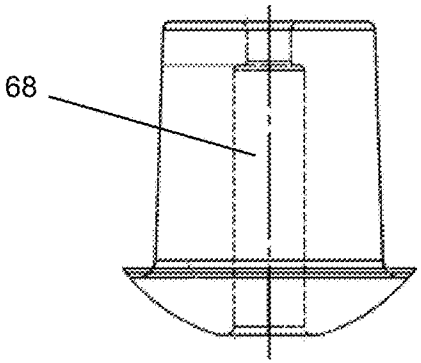
FIG. 12 is a side view of detail A from FIG. 11.

Referring now to FIGS. 9-12 an endplate cast 60 is shown. The endplate cast 60 is formed in a suitable mold created to form the initial shape and contours shown in FIG. 9. The initial shape and contours provide a basis for machining the bearing assembly housings 30, 32, 34 and mounting surfaces through which the fastener mounts 44 can be drilled. As seen in FIG. 9, the cast 60 forms the basis for an endplate 12, 14 with a base portion 62 and a pair of projections 64 extending from the base. The projections 64 provide the basis for machining the bearing assembly housings 30, 32, 34 to spec according to which end plate 12, 14 is being produced. The base portion 62 is originally formed with an outer ridge 66 due to the casting process. As seen in FIGS. 11 and 12, the projections 64 are cast with interior bores 68 to provide a basis for enlarging the housings 30, 32, 34 to accommodate the respective bearings and/or seals. It can be appreciated that the overall exterior and interior dimensions of the projections 64 may vary according to the specs required of the particular pump assembly 12, couplers, bearings or bushings, seals or other factors that would affect the interior space required and length of the housings 30, 32, 34.

Figure 13:
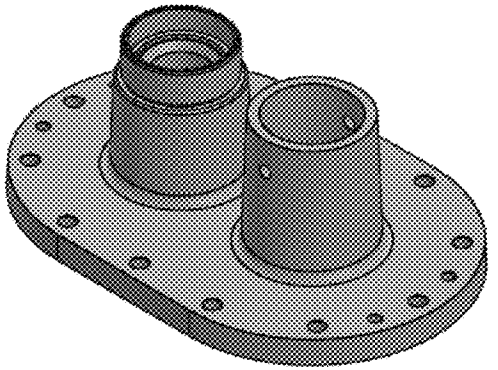
FIG. 13 is a perspective view of a front end plate produced from the cast.
Figure 14:
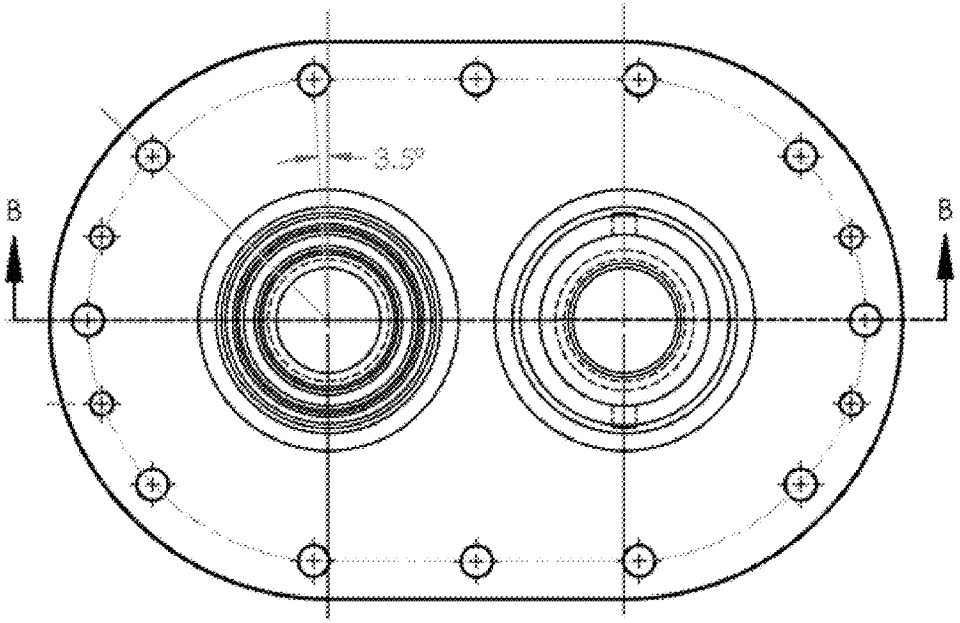
FIG. 14 is a plan view of the front end plate of FIG. 13.
Figure 15:
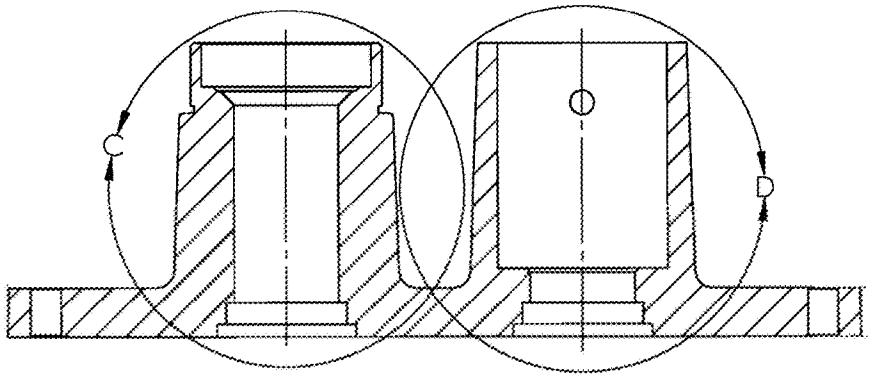
FIG. 15 is a cross-sectional view of the front end plate of FIG. 14 along line B-B in FIG. 14.
Figure 17:
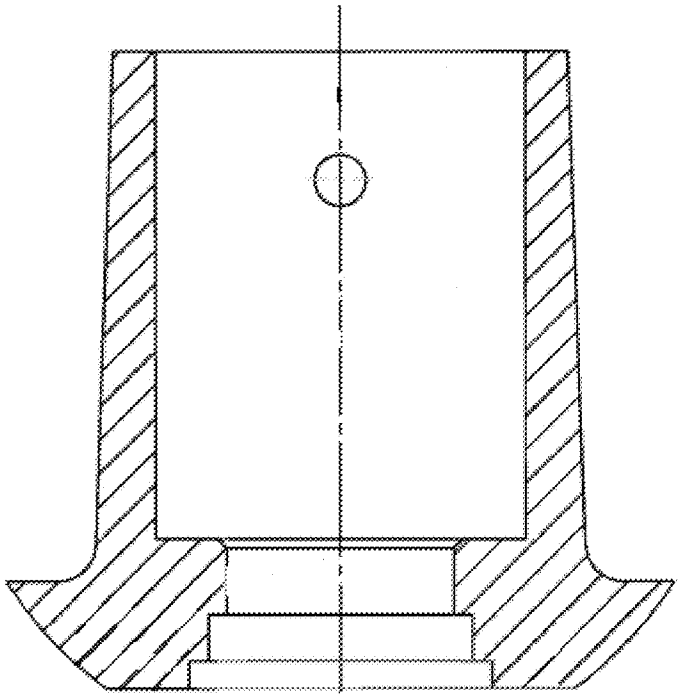
FIG. 17 is a cross-sectional view of detail D in FIG. 15.
Figure 16:
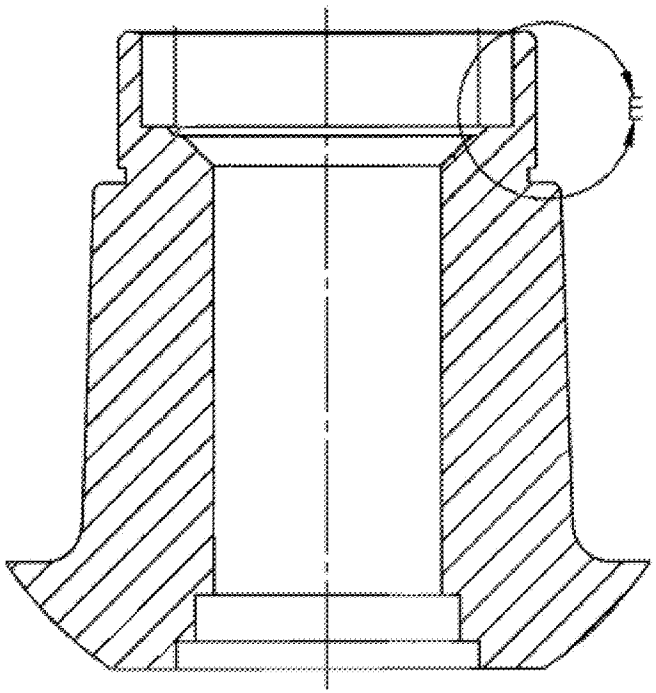
FIG. 16 is a cross-sectional view of detail C in FIG. 15.
Figure 18:
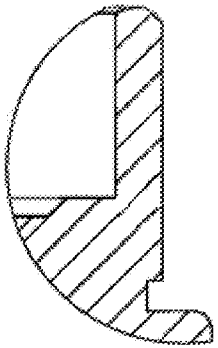
FIG. 18 is a cross-sectional view of detail E in FIG. 16.

FIGS. 13-15 illustrate one example of a front end plate 12 after having been machined from the cast 60. The base portion 62 is machined to provide a flush outer plate surface and the fastener mounts 44 are drilled through the base portion 62 to enable the front end plate 12 to be secured to the pump housing 16. The drive bearing mount assembly housing 30 and the idler bearing mount assembly housing 32 are also machined from the projections 64 to provide the appropriate cavities 40, 42 as discussed above. By forming the front end plate 12 from the cast 60, fewer components are required for the pump assembly 12. FIGS. 16-18 provide additional detail to illustrate the specs that can be achieved by machining the cast 60 to produce the front end plate 12. It is appreciated that the shape, configuration, dimensions, and proportions shown in FIGS. 14-18 are illustrative only and would vary based on the specifications of the particular application.

Figure 20:
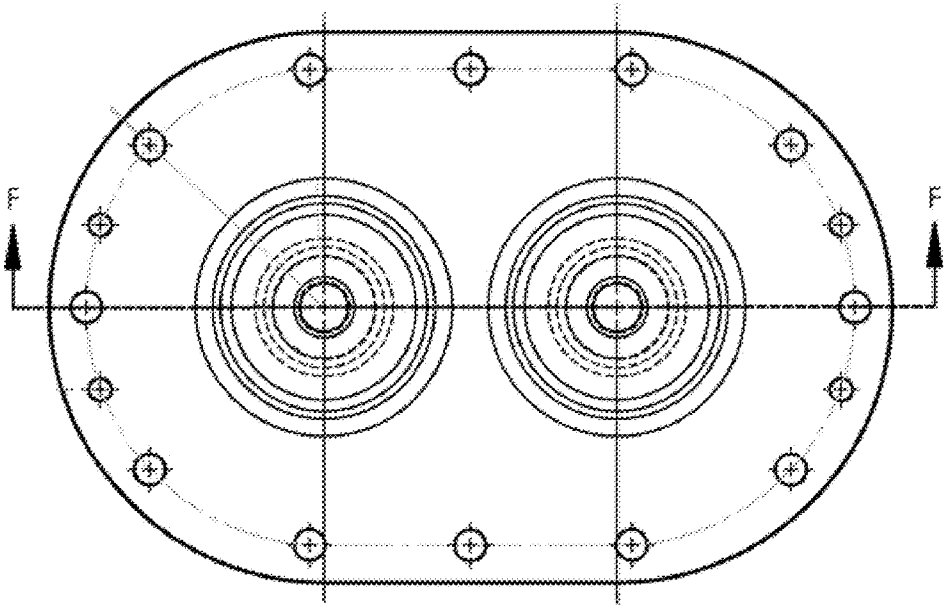
FIG. 20 is a plan view of the rear end plate of FIG. 19.
Figure 21:
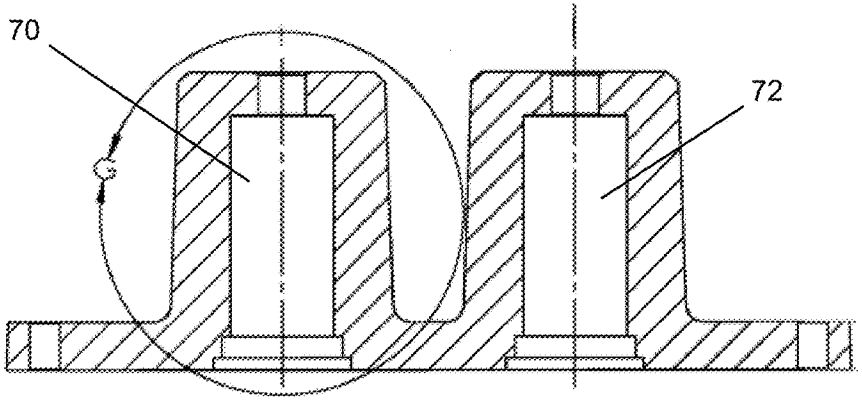
FIG. 21 is a cross-sectional view of the rear end plate of FIG. 20 along line F-F in FIG. 19.
Figure 19:
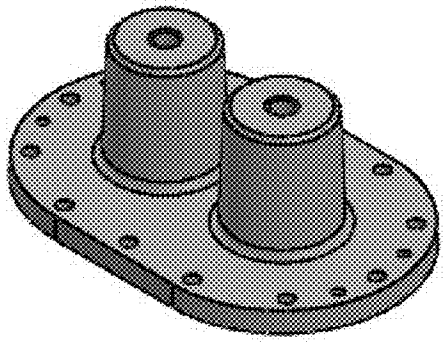
FIG. 19 is a perspective view of a rear end plate produced from the cast.
Figure 22:
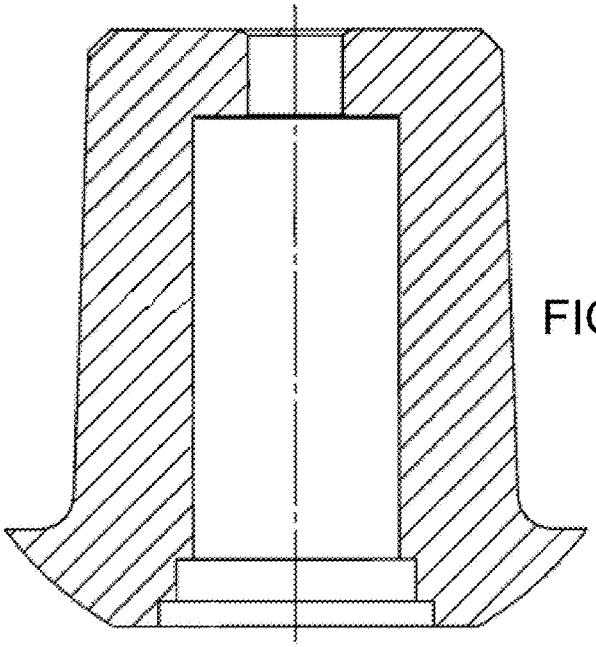
FIG. 22 is a cross-sectional view of detail G in FIG. 21.

FIGS. 19-22 illustrate the rear end plate 14 after having been machined from the cast 60. Again, the base portion 62 is machined to provide a flush outer plate surface and the fastener mounts 44 are drilled through the base portion 62 to enable the rear end plate 14 to be secured to the pump housing 16 opposite the front end plate 12. The bearing mount assembly housings 34 are also machined from the projections 64 to provide appropriate cavities 70, 72 (see FIG. 21) for receiving ends of the drive and idler shafts 12, 14. By forming the rear end plate 14 from the cast 60, fewer components are required for the pump assembly 12. It is appreciated that the shape, configuration, dimensions, and proportions shown in FIGS. 20-22 are illustrative only and would vary based on the specifications of the particular application.

For simplicity and clarity of illustration, where considered appropriate, reference numerals may be repeated among the figures to indicate corresponding or analogous elements. In addition, numerous specific details are set forth in order to provide a thorough understanding of the examples described herein. However, it will be understood by those of ordinary skill in the art that the examples described herein may be practiced without these specific details. In other instances, well-known methods, procedures and components have not been described in detail so as not to obscure the examples described herein. Also, the description is not to be considered as limiting the scope of the examples described herein.

It will be appreciated that the examples and corresponding diagrams used herein are for illustrative purposes only. Different configurations and terminology can be used without departing from the principles expressed herein. For instance, components and modules can be added, deleted, modified, or arranged with differing connections without departing from these principles.

The steps or operations in the flow charts and diagrams described herein are just for example. There may be many variations to these steps or operations without departing from the principles discussed above. For instance, the steps may be performed in a differing order, or steps may be added, deleted, or modified.

Although the above principles have been described with reference to certain specific examples, various modifications thereof will be apparent to those skilled in the art as outlined in the appended claims.

The invention claimed is:

1. An end plate for a pump assembly, comprising:

a unitary piece produced from a casting formed in a mold, the unitary piece comprising:

a base portion;

a pair of projections protruding outwardly from an outer surface of the base portion, the outer surface and the pair of projections being configured to be disposed outside the pump assembly when the end plate is secured thereto; and a mounting recess inwardly recessed into an interior surface of the base portion;

wherein, each of the pair of projections comprises a central bore from which a bearing assembly housing has been machined from solid material used to form the projection in the casting according to a type of end plate that corresponds to the end plate;

wherein the bearing assembly housing includes a shaft cavity for accommodating a drive shaft or an idler shaft from the pump assembly and respective bearings and/or seals according to the type of end plate; and wherein the mounting recess surrounds the shaft cavity of the bearing assembly housing, the mounting recess including a stepped configuration having an inner step surface and an outer step surface being sized and contoured to permit an inner plate bushing having a complementary configuration to be seated therein.

2. The end plate of claim 1, further comprising a peripheral ridge on the base portion.

3. The end plate of claim 2, further comprising fastener mounts machined into the peripheral ridge.

4. The end plate of claim 1, wherein the casting is formed from cast iron in a cast iron mold.

5. The end plate of claim 1, wherein each of the pair of projections comprises a cavity machined to accommodate an end portion of the respective shaft.

6. The end plate of claim 1, wherein each central bore extends through both the base portion and the respective projection.

7. A method for producing the end plate of claim 1, the method comprising:

pouring a material into the mold, the mold defining moldings to form the base portion and the pair of projections, each projection being composed of material from which to machine the respective bearing assembly, wherein each of the pair of projections comprises more material than is needed to form the respective bearing assembly housing;

forming the casting from the mold; and machining the base portion and the pair of projections to create fastener mounts and to accommodate the respective drive and idler shafts, bearings and/or seals of the pump assembly based on a type of end plate being produced.

8. The method of claim 7, wherein a peripheral ridge is formed on the base portion.

9. The method of claim 7, wherein the casting is formed from cast iron in a cast iron mold.

10. The method of claim 7, wherein each of the pair of projections comprises a cavity to be machined to accommodate an end portion of the respective shaft.

11. The method of claim 7, wherein each of the projections defines an interior bore to provide a basis for enlarging the assembly housings to accommodate respective bearings and/or seals.

12. The method of claim 11, wherein each interior bore extends through both the base portion and the respective projection.

13. The method of claim 7, further comprising machining a mounting recess in the end plate to accommodate an inner plate bushing.

14. The method of claim 13, wherein the mounting recess comprises an inner portion to receive a collar of the inner plate bushing, and an outer portion to receive a flange of the inner plate bushing.

15. The method of claim 14, wherein the collar is to be inserted into the mounting recess in the end plate with the flange seated flush with a surface of the end plate.

16. The method of claim 15, wherein the surface area of an end of the collar is larger than an inner surface of the flange.

17. A pump assembly comprising:

a pump housing configured to house a plurality of pump components and permit rotation of a drive shaft and an idler shaft therein during operation;

a front end plate and a rear end plate configured to align and receive the drive shaft and the idler shaft and seal the pump housing from opposite sides during operation, wherein each of the front end plate and the rear end plate comprising:

a drive bearing assembly housing and an idler bearing assembly housing protruding outwardly from an outer surface of the respective end plate, the outer surface and the drive and idler bearing assemblies being configured to be disposed outside the pump assembly when the front and rear end plates are secured thereto, wherein each of the drive and idler bearing assembly housing includes a shaft cavity for supporting and enabling rotation of the respective drive and idler shaft; and a pair of mounting recesses, each being inwardly recessed into an interior surface of the respective end plate and surrounding the shaft cavity of the respective drive and idler bearing assembly housing; and a plurality of inner plate bushings, each configured to be seated within respective one of the mounting recesses provided on each of the front and rear end plates, each inner plate bushing including:

a central passage surrounded by a flange and a collar extending coaxially from the flange, the central passage being configured to align with the respective shaft cavity provided in the end plates and permit the respective one of drive shaft and idler shaft to pass therethrough;

wherein each of the mounting recesses includes a stepped configuration having an inner step surface configured to be sized and contoured to receive the collar of the inner plate bushing and an outer step surface configured to be sized and contoured to receive the flange to be seated flush with the interior surface of the respective end plate surrounding the respective mounting recess.

18. The pump assembly of claim 17, wherein:

the collar includes an annular end surface extending in a radial direction with respect to the central passage to define a width of the annular end surface, the annular end surface being configured to be seated within the inner step surface of the mounting recess of the end plate;

the flange includes an annular inner surface extending in the radial direction with respect to the central passage and radially outwardly from the collar to define a width of the annular inner surface, the annular inner surface being configured to be seated in the outer step surface of the mounting recess to be flush with the surface of the end plate; and wherein the width of the annular end surface of the collar is larger than the width of the annular inner surface of the flange.

* * * * *